US005502262A

United States Patent [19]

Yamasaki et al.

[11] Patent Number: 5,502,262

[45] Date of Patent: Mar. 26, 1996

[54] PROCESS FOR THE CONVERSION OF VULCANIZED RUBBERS INTO OILS BY USE OF SUPERCRITICAL AQUEOUS FLUIDS

[75] Inventors: Nakamichi Yamasaki, Kochi; Kenji Tsuda, Hiroshima; Hiroyuki Okuda, Hiroshima; Toshinari Tenno, Hiroshima, all of Japan

[73] Assignees: Nakamichi Yamasaki, Kochi; Nishikawa Rubber Co., Ltd., Hiroshima, both of Japan

[21] Appl. No.: 219,104

[22] Filed: Mar. 29, 1994

[30] Foreign Application Priority Data

| | | | |
|---|---|---|---|
| Apr. 1, 1993 | [JP] | Japan | 5-100403 |
| Apr. 1, 1993 | [JP] | Japan | 5-100404 |
| Apr. 1, 1993 | [JP] | Japan | 5-100405 |

[51] Int. Cl.[6] ..... C07C 7/00; C07C 1/32

[52] U.S. Cl. ..... 585/241; 208/247; 208/108

[58] Field of Search ..... 585/241; 208/91, 208/213, 226, 242, 243, 246, 247, 248

[56] References Cited

U.S. PATENT DOCUMENTS

| | | | |
|---|---|---|---|
| 4,458,095 | 7/1984 | Wingfield, Jr. et al. | 585/241 |
| 4,483,761 | 11/1984 | Paspek, Jr. | 208/106 |
| 4,642,401 | 2/1987 | Coenen et al. | 585/241 |

*Primary Examiner*—Asok Pal
*Assistant Examiner*—Bekir L. Yildirim
*Attorney, Agent, or Firm*—Flynn, Thiel, Boutell & Tanis

[57] ABSTRACT

A process for the desulfurization of a sulfur-containing composition is described. The process comprises providing a sulfur-containing composition, adding an aqueous medium and a sulfur absorbent to the composition, and subjecting the resultant mixture to hydrothermal reaction under specific conditions to obtain a desulfurized product. When the sulfur-containing composition is made of vulcanized rubbers, the rubber can be converted into oily substances by treating the rubber product under supercritical conditions using an aqueous medium. The conversion reaction is facilitated by addition of metal oxides or salts.

11 Claims, 13 Drawing Sheets

TEMPERATURE (°C)

THE NUMERALS, RESPECTIVELY, INDICATE A PACKING RATE.

PROCESS FOR THE CONVERSION OF VULCANIZED RUBBERS INTO OILS BY USE OF SUPERCRITICAL AQUEOUS FLUIDS

BACKGROUND OF THE INVENTION

1. Field of the Invention

This invention relates to a process for the desulfurization of sulfur-containing compositions by hydrothermal reaction. By the process, it becomes possible to desulfurize fossil fuels, to eliminate harmful sulfur components at the time of preparation of polymers and to regenerate vulcanized rubber products. The invention also relates to a process for the conversion of vulcanized rubber products, such as tires, hoses and the like rubber articles, into oils for recycling purposes. The invention also relates to a catalyst which is useful for the oil conversion reaction of vulcanized rubber products.

2. Description of the Prior Art

As is known in the art, hydrodesulfurization processes have been widely used for purification and desulfurization. For instance, the pan process has been employed for the regeneration of vulcanized rubber. However, the known hydrodesulfurization processes have the problem that side products are produced and that when vulcanized rubber is regenerated, a sulfur component is inevitably left in the regenerated rubber. More particularly, the known processes are disadvantageous in the formation of side products and a low desulfurization rate.

In general, vulcanized rubber articles have been utilized as regenerated rubber, for example, according to the above-mentioned pan process wherein the crosslinkages are broken. Alternatively, vulcanized rubber articles have been merely burnt down in incinerators for recovery as thermal energy. The utilization of the vulcanized rubber articles as regenerated rubber means the re-use of the articles, but is not truly recycling them. On the other hand, the recovery as the thermal energy after combustion has the problem that the rubber articles are not utilized as a renewable resource with the added value not being high.

SUMMARY OF THE INVENTION

It is an object of the present invention to provide a process for the desulfurization of sulfur-containing compositions whereby a very high desulfurization rate can be achieved without any adverse influence on the compositions.

It is another object of the invention to provide a desulfurization process using hydrothermal reaction whereby desulfurization of fossil fuels, elimination of harmful sulfur components at the time of the preparation of polymers and regeneration of vulcanized rubber can be efficiently carried out.

It is a further object of the invention to provide a process for the conversion or decomposition of vulcanized rubber articles into low molecular weight hydrocarbons at a high conversion rate.

It is a still further object of the invention to provide a catalyst which is effectively employed in the process for the conversion or decomposition of vulcanized rubber articles.

According to one embodiment of the invention, there is provided a process for the desulfurization of a sulfur-containing composition which process comprises providing a sulfur-containing composition, adding an aqueous medium and a sulfur absorbent to the composition, and subjecting the resultant mixture to hydrothermal reaction under conditions of a temperature of from 350° to 420° C. and a pressure not lower than 150 kg/cm$^2$ for a time sufficient for the desulfurization. Preferably, the aqueous medium may be an alkaline aqueous solution although water may be used. When the composition is subjected to the desulfufization under such hydrothermal conditions as defined above, the reaction velocity remarkably increases.

According to another embodiment of the invention, there is also provided a process for the conversion of vulcanized rubber products into an oil mixture composed mainly of hydrocarbons which process comprises providing a rubber product vulcanized with sulfur or a peroxide, adding an aqueous medium to the rubber product, subjecting the resultant mixture to decomposition under supercritical conditions of a temperature of from 374° to 500° C. and a pressure not lower than 225 kg/cm$^2$ thereby obtaining an oily substance mainly composed of mixed hydrocarbons. In a preferred embodiment of the invention, not less than 5 wt %, based on the rubber product, of a metal salt or oxide is added to the mixture to facilitate the decomposition of the vulcanized rubber product by means of the supercritical aqueous medium.

PREFERRED EMBODIMENTS OF THE INVENTION

In the desulfurization process according to one embodiment of the invention, a sulfur-containing organic composition or product is first provided. If the composition or product is solid in nature, such a product is cut or divided into fine pieces. Thereafter, an aqueous medium is added to the composition or product along with a sulfur absorbent. The resultant aqueous mixture or dispersion is then subjected to hydrothermal treatment under specific conditions to obtain phase separated products including an organic phase, an aqueous phase and a solid phase. When the organic phase is separated from the other phases and subjected to fractionation, a substantially sulfur-free organic product is obtained.

Figure 1:
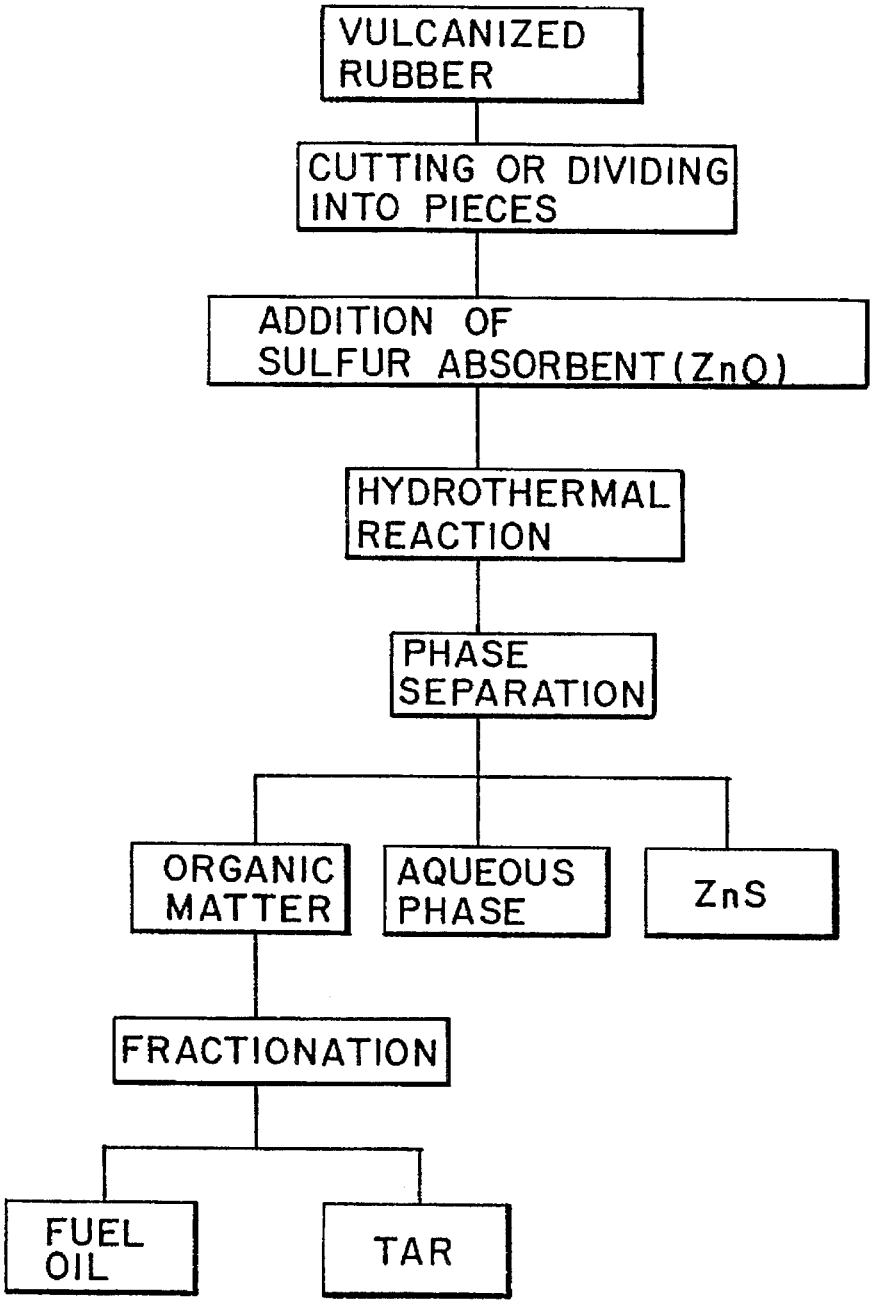
FIG. 1 is a flow chart showing a desulfurization process according to one embodiment of the invention.

Reference is now made to the accompanying drawings and particularly, to FIG. 1. FIG. 1 shows a process for desulfurizing a vulcanized rubber product which is typical of the sulfur-containing composition according to one embodiment of the invention. In the figure, a vulcanized rubber is first provided. Preferably, the rubber is cut or divided into fine pieces. Subsequently, an aqueous medium is added to the fine pieces along with a sulfur absorbent and the rubber is subjected to hydrothermal treatment and phase separation to obtain an organic phase, an aqueous phase and a metal sulfide. When the organic phase is subjected to fractionation, a hydrocarbon oil and tar can be obtained.

The starting sulfur-containing composition or product used in the present invention may be a variety of vulcanized rubbers such as vulcanized natural rubbers, vulcanized synthetic rubbers such as ethylene-propylene-diene methylene linkage rubber and the like, fossil fuels, starting monomers used to prepare polymers so far as they contain sulfur bonds therein.

If the starting composition or product is solid in nature, it is preferred that the composition or product is divided or cut into fine pieces in order to facilitate the hydrothermal treatment.

In the desulfurization process of the invention, the starting composition or product is subsequently mixed with an aqueous medium and a sulfur absorbent. Examples of the aqueous medium include water and a basic aqueous solution. The basic aqueous solution includes, for example, an aqueous solution of an alkali metal or alkaline earth metal hydroxide or salt such as NaOH, KOH, $Ca(OH)_2$ or the like. Preferably, a 1 to 5N basic aqueous solution is used. More preferably, NaOH is used because of its easy availability. If water is used, it takes a longer time for attaining the same level of the desulfurization or before completion of the hydrothermal treatment. Examples of the sulfur absorbent include metal salts such as $Pd(NO_3)_2$, $Fe(ClO_4)_3$, $K_2S_2O_8$ and the like, and metal oxides such as ZnO, CoO, $MoO_3$, NiO and the like.

The sulfur absorbent should be added in an amount equivalent to or higher than the amount of sulfur in the starting material. In this connection, however, with sulfur-vulcanized rubbers, if ZnO or the like vulcanization aid is present in an amount which satisfies the above requirement, it is not always necessary to further add the sulfur absorbent.

The mixture comprising a starting material, an aqueous medium and a sulfur absorbent is subjected to hydrothermal treatment wherein high temperature and high pressure water is present. The hydrothermal treatment is usually effected in a pressure-resistant container, such as an autoclave, under conditions of a temperature of from 350° to 420° C. and a pressure not lower than 150 kg/cm$^2$ for a time sufficient for desulfurization. The reaction time is preferably so determined to attain a sulfur content (which is defined hereinafter) of not larger than 0.5%.

The desulfurization through the hydrothermal treatment is, more or less, influenced by several parameters including a packing rate, the weight percent of a starting material, the reaction time and the sulfur content. These parameters are defined in the present invention as follows.

Packing rate (%): (total in volume of starting material and aqueous medium)/(inner volume of an autoclave)×100

Weight percent of starting material: (weight of starting material)/(total in weight of starting material and aqueous medium)× 100

Reaction time: retention time after arrival at a predetermined reaction temperature Sulfur content (%): (amount of sulfur in a final oil product)/(amount of sulfur in starting material)×100

Under the hydrothermal reaction conditions defined hereinbefore, ionization vigorously takes place in the reaction system, by which the hydrothermal reaction proceeds very actively. This results in a pronounced increase of the reaction velocity. The sulfur bonds in the composition or product which may be solid, liquid or gaseous in nature are broken. The resultant free sulfur component is instantaneously joined to the metal component generated from the sulfur absorbent or originally contained in the composition. When water is used, it has no ionic species in itself. However, ionic sources are contained in the starting composition or product and are dissolved out in water, thus resulting in the hydrothermal reaction based on the ionization. In this sense, the use of a basic aqueous solution having a normality of not smaller than 1 is preferred. In fact, the reaction proceeds more rapidly when using the basic aqueous solution.

The packing rate is preferably in the range of from 10 to 40% and the weight percent of the starting material is from 30 to 70%. The reasons for this will be described in detail in another embodiment appearing hereinafter.

As stated hereinbefore, the process according to this embodiment of the invention is applicable not only to regeneration of vulcanized rubber products, but also to desulfurization of fossil fuels such as coal, crude oils and natural gases and also to removal of harmful sulfur component from starting materials used to prepare polymers.

The invention is more particularly described by way of example.

EXAMPLE

A vulcanized rubber which was made of a composition comprised of 100 parts by weight of ethylene-propylene-diene-methylene linkage rubber (EPDM), 3 parts by weight of dixylyl disulfide, 5 parts by weight of zinc oxide, 2 parts by weight of sulfur and 2 parts by weight of an accelerator DM was cut or divided into fine pieces. 3 parts by weight of ZnO serving as a sulfur absorbent was added to the fine pieces as shown in FIG. 1. Thereafter, a 1N NaOH aqueous solution or pure water was added to the mixture at a weight, percent of the starting rubber of 23%. The mixture was placed in an appropriate pressure-resistant container such as a small-sized autoclave at a packing rate of 40%. Then, the container was placed in an induction heating-furnace using commercial electric current. The content was heated at a rate of 40° C./minute to a temperature of 420° C., at which the hydrothermal treatment was effected for 30 minutes for the NaOH aqueous solution and for 1.5 hours for pure water. The phase-separated product was obtained by fractionation to obtain a fuel oil mainly composed of hydrocarbons and a tar.

The influence of the type of aqueous medium on the sulfur content in the oil was as follows.

| Aqueous medium | Sulfur Content (%) |
|---|---|
| 1N-NaOH aqueous solution | 0.46 |
| Pure water | 5.6 |

As will be apparent from the above results, the use of the basic aqueous solution is preferred.

In this example, the sulfur content in the starting vulcanized rubber was 3.1% and the sulfur content in the final oil was 0.028% when using the NaOH aqueous solution. Thus, the desulfurization rate was 99.92%. It will be seen that the desulfurization process according to this embodiment is very effective.

In the above example, the carbon black free vulcanized rubber was used. When a vulcanized rubber containing a carbon black additive is used, similar results are obtained.

Another embodiment of the invention is then described. In this embodiment, starting vulcanized rubber is converted into a hydrocarbon oil under supercritical conditions using an aqueous medium. Under these conditions, liquid phase reactions occurring through ions and vapor phase reactions occurring through radicals are homogeneously caused to proceed. A very high reaction velocity is ensured.

Figure 2:
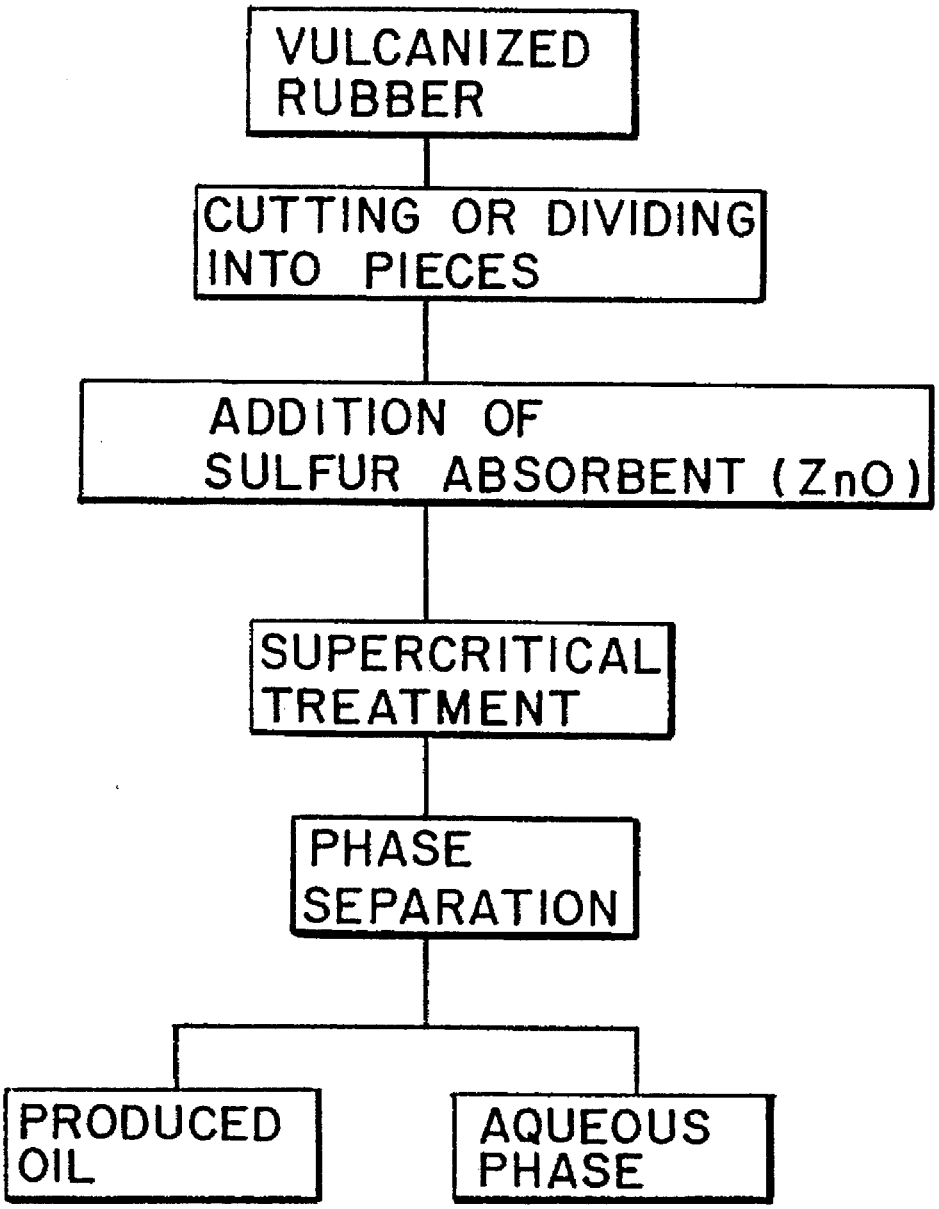
FIG. 2 is a flow chart showing a process for the conversion or decomposition of vulcanized rubber into a hydrocarbon mixture.

According to this embodiment of the invention, a starting vulcanized rubber product is first provided as shown in FIG. 2. The product is preferably divided or cut into fine pieces as in the first embodiment. An aqueous medium such as water or a basic aqueous solution is added to the fine pieces. Thereafter, the mixture is subjected to decomposition into an oily substance under supercritical conditions of an aqueous medium. As a consequence, the reaction mixture is separated into an oily phase and an aqueous phase with solid matters settling out.

The starting vulcanized rubber product may include rubbers vulcanized with sulfur or peroxides. Such rubbers include not only synthetic rubbers, but, also natural rubbers. In view of the quality of the final oily substance, it is preferred to use synthetic rubber such as ethylene-propylene-diene methylene linkage rubber, SBR, NBR, IIR and the like.

The aqueous medium being mixed with the starting rubber may be water. Preferably, a basic aqueous solution as used in the first embodiment is used, typical of which is a 1 to 5N NaOH aqueous solution.

The mixture is treated in a pressure-resistant container under supercritical conditions of a temperature ranging from 374° to 500° C. and a pressure ranging not lower than 225 kg/cm$^2$. The composition and yield of a final oily substance may, more or less, depend on several reaction parameters including not only the temperature and the pressure, but also the reaction time, the weight percent of starting rubber, the packing rate, the type of aqueous medium. In addition, as will be more particularly described hereinafter, the presence of a metal oxide or salt in the reaction system greatly influences the yield of final product and the reaction velocity.

Figure 3:
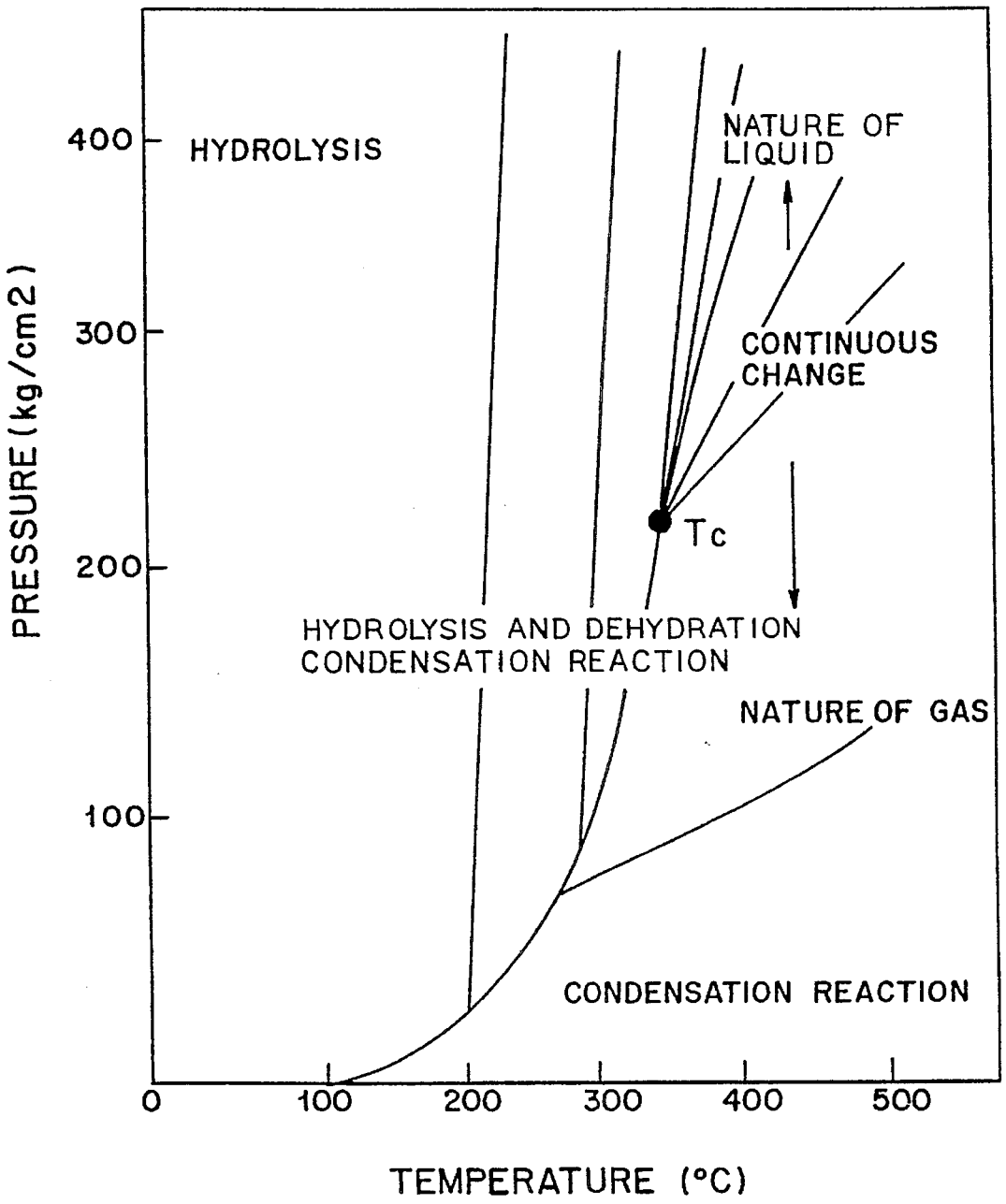
FIG. 3 is a graph showing the type of reaction product or species in relation to the variations in temperature and pressure of an aqueous medium.

The reactions under supercritical conditions under which the temperature should be higher than a critical temperature as high as 374 ° C. or over in a closed system are particularly shown in FIG. 3. As will be apparent from FIG. 3, at a temperature lower than 200° C., vulcanized rubber undergoes hydrolysis. At a pressure lower than 150 kg/cm$^2$, the rubber undergoes dehydration and condensation. Under appropriately controlled supercritical conditions, the rubber undergoes both hydrolysis and condensation through dehydration. More particularly, bonds between hetero-atoms and saturated carbon atoms are split off through hydrolysis. In addition, the decomposition reaction of the rubber into an oily substance becomes very rapid.

The interrelations between the reaction time, the weight percent of starting rubber, the packing rate, the oil yield, the weight of sticky matter and the like are determined according to the following fundamental procedure.

A starting vulcanized rubber which is made of 100 parts by weight of EPDM, 3 parts by weight of dixylyl disulfide, 5 parts by weight of zinc oxide, 2 parts by weight of sulfur and 2 parts by weight of an accelerator, DM, is divided into fine pieces. Thereafter, 3 parts by weight of ZnO serving as a sulfur absorbent is added to the fine pieces, followed by charging into a NaOH aqueous solution in an inductive heating furnace or a small-sized autoclave for decomposition of the vulcanized rubber into an oily substance under supercritical conditions.

Figure 4:
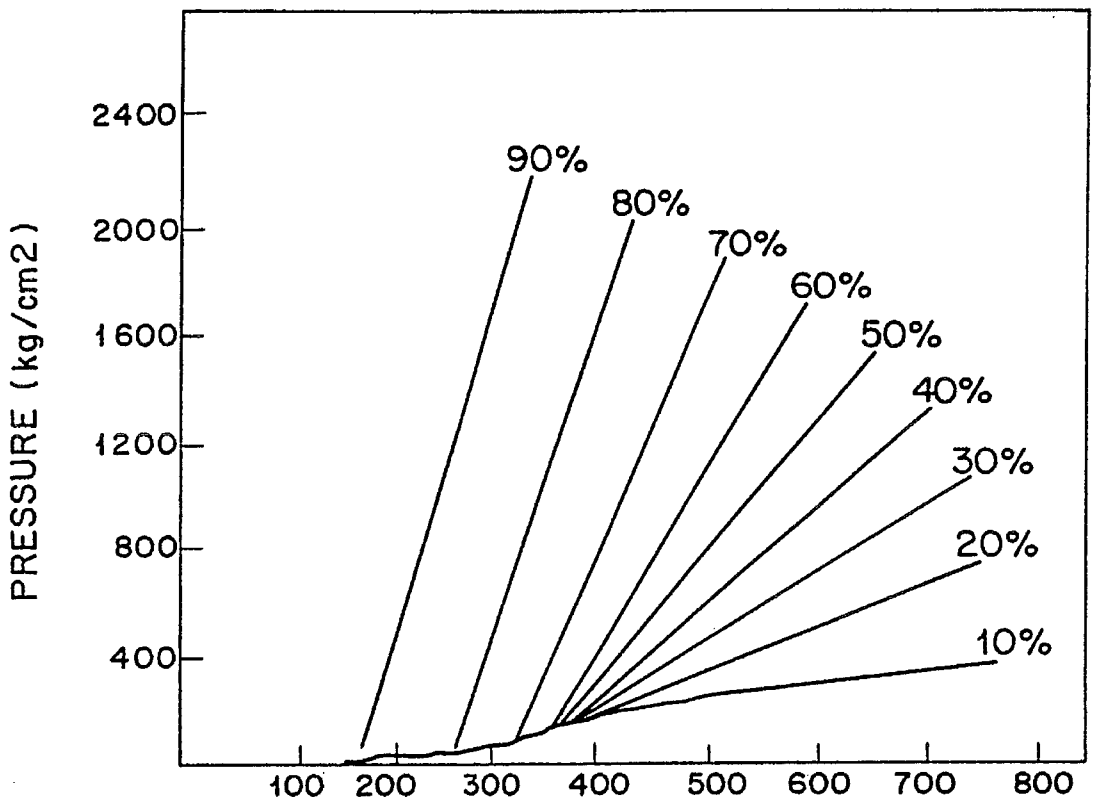
FIG. 4 is a graph showing the packing rate in relation to the variations in temperature and pressure of an aqueous medium.

In FIG. 4, there is shown the packing rate in relation to the variations in the temperature and the pressure. As will be seen from the figure, if higher pressures are used, the packing rate may be increased. Similarly, if higher temperatures are used, a higher packing rate cannot be used. Within the supercritical conditions defined hereinbefore, the packing rate is preferably in the range of from 10 to 40%.

Figure 5:
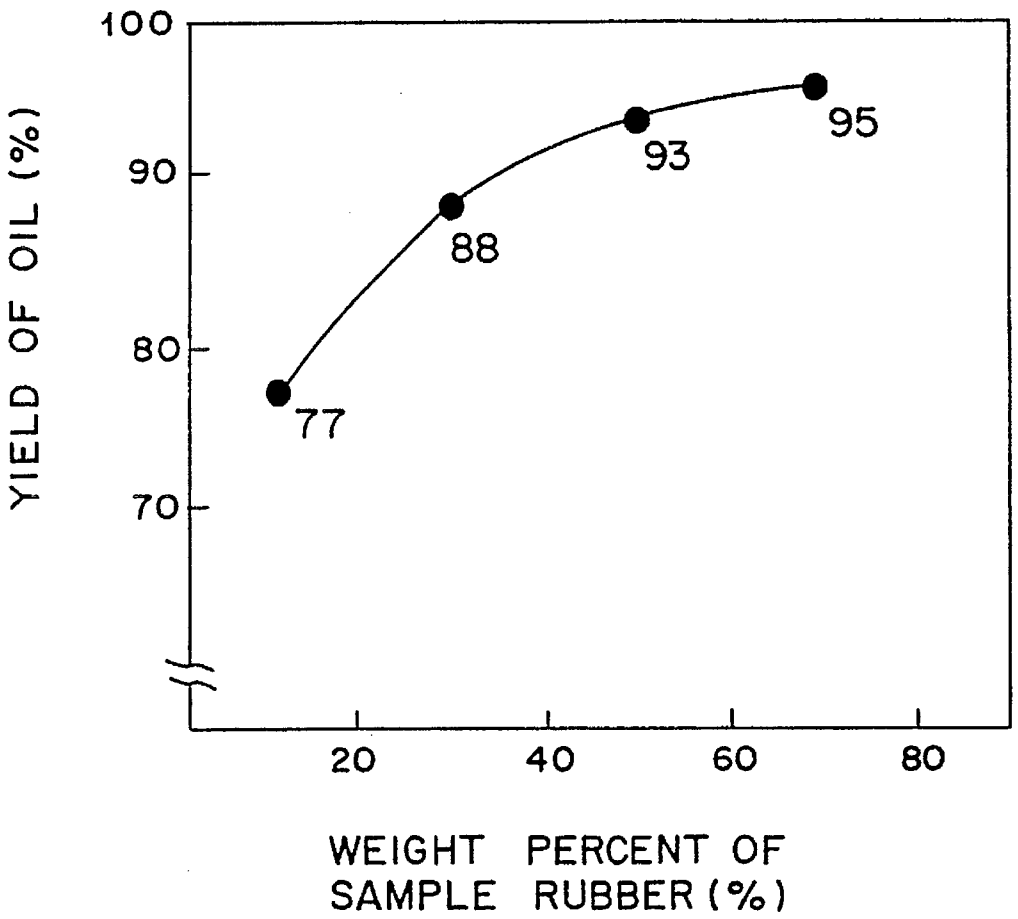
FIG. 5 is a graph showing the relation between the hydrocarbon oil yield and the weight percent of a rubber sample.

FIG. 5 shows the relation between the yield of an oily substance and the weight percent of the starting rubber when determined under conditions where the starting rubber is heated to 420° C. at a heating rate of 40° C./minute at a packing rate of 25% while changing the weight percent of the starting rubber from 10 to 70%. As will be seen from the figure, a high weight percent results in a higher yield of the oil. From the standpoint of the oil yield, the weight percent is preferably in the range of from 30 to 70%.

From FIGS. 4 and 5, it will be appreciated that when the vulcanized rubber is treated under supercritical conditions where the temperature exceeds a critical temperature of 374° C., an oily substance can be appropriately obtained although the yield may be varied depending on the reaction parameters.

It will be noted here that the oily substance obtained in this and the foregoing embodiments of the invention is mainly composed of paraffinic hydrocarbons which amount to 50 to 60 wt % of the total oily substance. Aside from the paraffinic hydrocarbons, the substance further contains olefinic hydrocarbons. Minor amounts of alcohols and cyclic compounds may also be contained depending on the type of starting vulcanized rubber. The paraffinic and olefinic hydrocarbons have, respectively, from 15 to 25 carbon atoms in major proportions. The alcohols include, for example, 1-octadecanol and 1-dodecanol, and the cyclic compounds include, for example, cyclopentane and cyclohexane and the like. Needless to say, if necessary, the hydrocarbons may be separated from other components by a usual manner.

Figure 6:
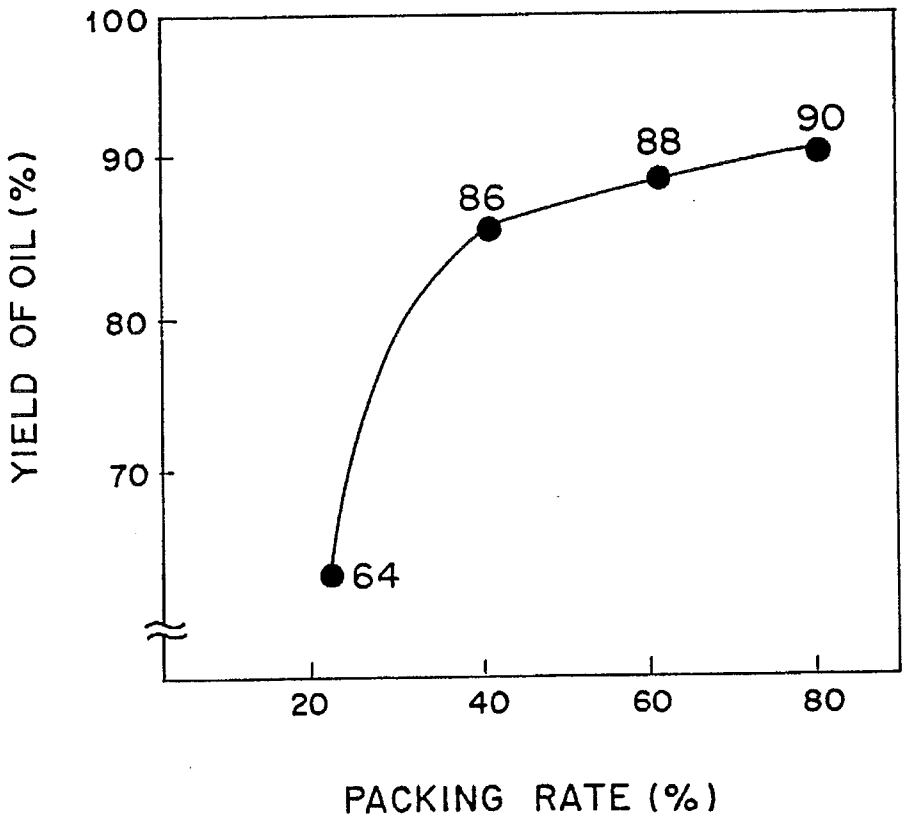
FIG. 6 is a graph showing the relation between the hydrocarbon oil yield and the packing rate.

FIG. 6 shows the relation between the yield of the oily substance and the packing rate. In this procedure, the weight percent of the starting rubber is maintained at 30% while changing the packing rate. From FIGS. 4 and 6, it will be seen that although a packing rate raging from 10 to 80% may be used, it is preferred to use a packing range of not less than 40%.

Figure 7:
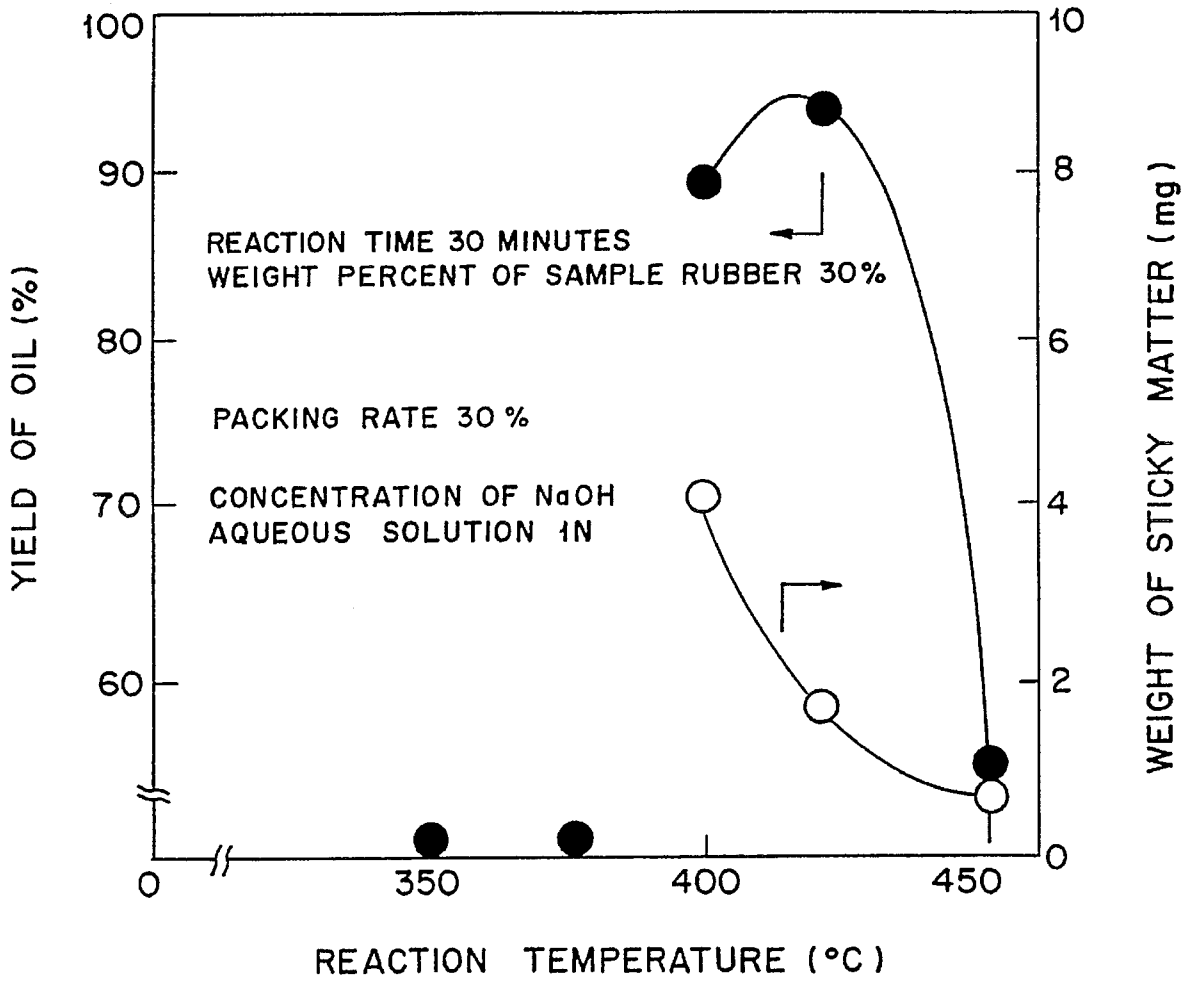
FIG. 7 is a graph showing the hydrocarbon oil yield or the weight of sticky material in relation to the variation in the reaction temperature.

FIG. 7 shows the relation between the yield of the oily substance or the weight of sticky matter and the reaction temperature. In this test procedure, the reaction conditions are determined such that the reaction time is 30 minutes, the weight percent of the starting rubber is 30%, the packing rate is 30% and the concentration of the NaOH aqueous solution is 1N.

The weight of sticky matter is determined by placing an oily substance in a glass tube, immersing a glass bar to a depth of 1 cm from the top surface of the oily substance, and removing the bar to measure the weight of the attached oily substance. This weight is taken as the weight of sticky matter and is evaluated as a relative viscosity of the oily substance.

In FIG. 7, the oil yield is indicated by the mark "●" and the weight of sticky matter is indicated by the mark "○". From this figure, it will be seen that in a temperature range where the supercritical conditions are not created or the temperature does not reach 374° C., the conversion into an oily substance does not take place. On the other hand, when the temperature exceeds 450° C., the liquefaction is completed and the oily substance is caused to be lower in molecular weight, or to be gasified. This results in lowerings of the weight of the sticky matter and the oil yield.

Figure 8:
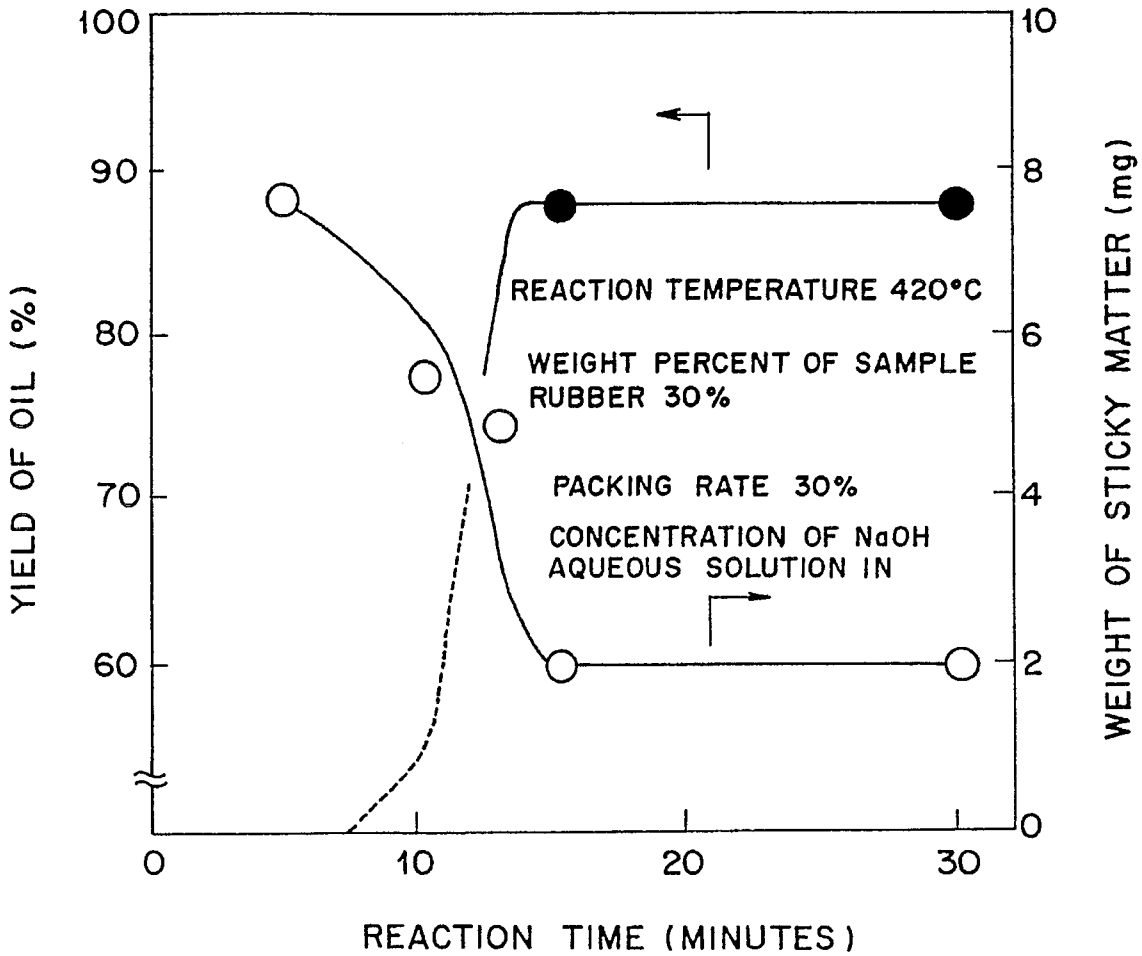
FIG. 8 is a graph showing the hydrocarbon oil yield or the weight of sticky material in relation to the variation in the reaction time.

Likewise, FIG. 8 shows the relation between the yield of the oily substance or the weight of sticky matter and the reaction time. In this test procedure, the reaction conditions are determined such that the reaction temperature is set at 420° C., the weight percent of the starting rubber is 30%, the packing rate is 30% and the concentration of the NaOH aqueous solution is 1N.

In FIG. 8, the oil field is indicated by the mark "●" and the weight of sticky matter is indicated by the mark "○". From this figure, it will be seen that in a reaction time which is shorter than 15 minutes, the decomposition of the oily substance proceeds with the weight of the sticky matter being reduced. However, an undecomposed rubber residue is left. When the reaction time exceeds 15 minutes, the weight of the sticky matter and the oil yield do not substantially change. In view of this, the reaction time is preferably not shorter than 15 minutes.

Figure 9:
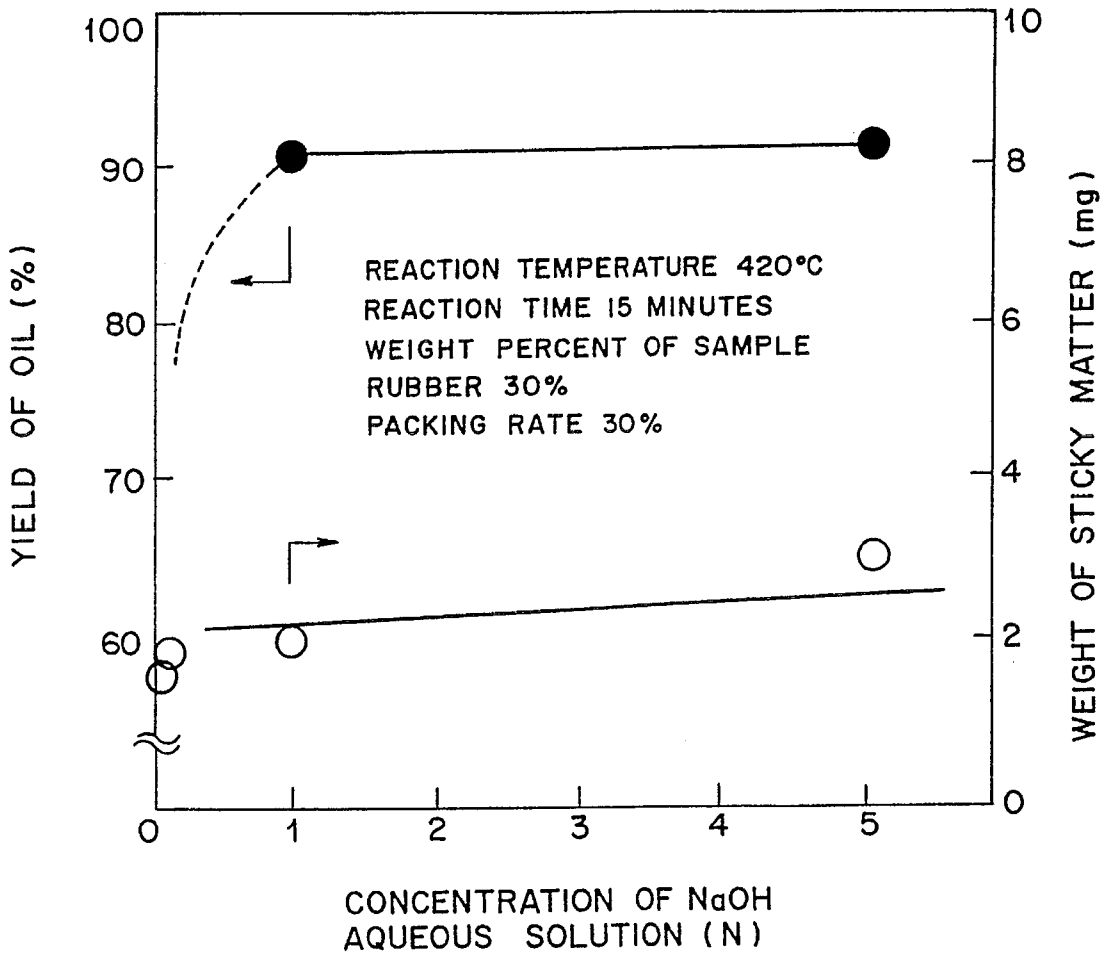
FIG. 9 is a graph showing the hydrocarbon oil yield or the weight of sticky material in relation to the variation in the concentration of NaOH in a NaOH aqueous solution.

FIG. 9 shows the relation between the yield of the oily substance or the weight of sticky matter and the concentration of the aqueous NaOH solution. Although the decomposition reaction is completed using water as the reaction medium, use of a base such as NaOH can significantly increase the reaction velocity. Accordingly, the reaction time can be shortened to a significant extent. In this test procedure, the reaction conditions are determined such that the reaction temperature is set at 420 ° C., the reaction time is 15 minutes, the weight percent of the starting rubber is 30% and the packing rate is 30%, as shown in FIG. 9.

The influence of the concentration of NaOH on the reaction completion time is summarized as follows.

| Concentration of NaOH (Normality) | Reaction Completing Time (Minutes) |
|---|---|
| 0 | 120 minutes*[1]) |
| 1 | 15 |
| 2 | 15 |
| 3 | 15 |
| 5 | 15 |
| 10 | 15 |

*[1])The oil conversion is completed when the reaction time is 120 minutes.

Gathering the foregoing, preferable supercritical reaction conditions of the process of the invention include a reaction temperature of from 400° to 500° C., more preferably from 400° to 450° C., a reaction time of not shorter than 15 minutes for a basic aqueous solution and of not shorter than 120 minutes for water, and a packing rate of from 10 to 80%. In addition, a basic aqueous solution is preferred to water for use as the reaction medium. If the reaction temperature higher than 450° C. is used, it may not be possible to completely seal a pressure-resistant container in view of the structure thereof. Although the packing rate larger than 80% may be used, hermetic sealing of the container under such conditions will be difficult.

It will be noted that in the second embodiment of the invention, it is essential that the reaction medium, i.e. water or a basic aqueous solution, be in a supercritical condition when the conversion or decomposition reaction is conducted.

The conversion reaction velocity can be further improved by addition of a metal salt or oxide to the reaction system as set forth in connection with the second embodiment of the invention. As stated in the second embodiment of the invention, it takes about 15 minutes or longer before the conversion reaction has been completed under supercritical conditions. Within 15 minuets, an undecomposed rubber residue may be left in the reaction system.

Figure 10:
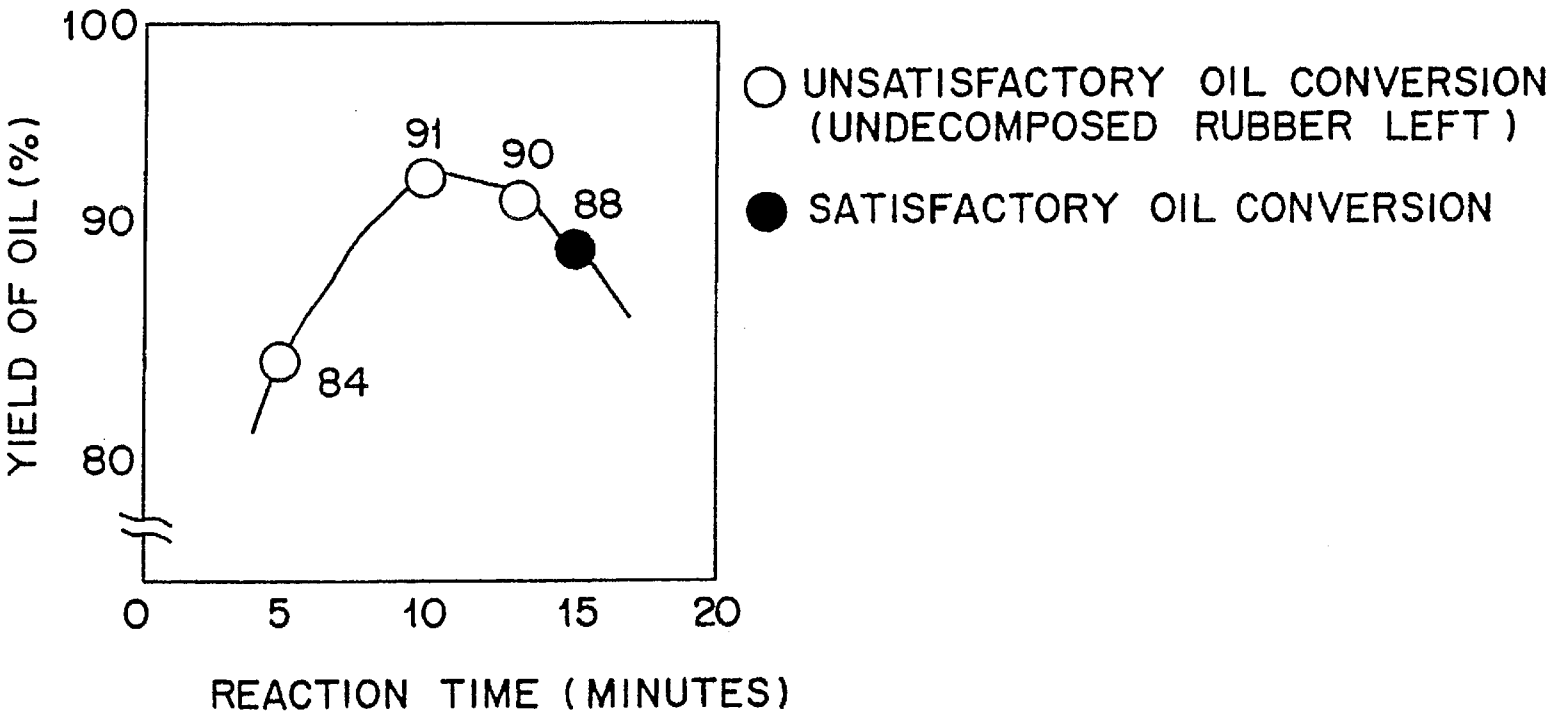
FIG. 10 is a graph showing the relation between the oil yield and the reaction time without use of any metal salt or oxide catalyst.

A starting vulcanized rubber which is composed of 100 parts by weight of EPDM, 3 parts by weight of dixylyl disulfide, 5 parts by weight of zinc oxide, 2 parts by weight of sulfur and 2 parts by weight of an accelerator DM, is divided into fine pieces. The fine pieces are placed in an 1N-NaOH aqueous solution and subjected to decomposition into an oily substance under supercritical conditions of a weight percent of the starting rubber of 30%, a packing rate of 30% and a temperature of 420° C. to which the fine pieces are heated at a rate of 40° C./minute. The relation between the reaction time and the oil yield is shown in FIG. 10. In the figure, the mark "○" indicates incomplete oil conversion, i.e. an undecomposed rubber being left and the mark "○" indicates substantially complete oil conversion. As having stated hereinbefore with respect to the second embodiment, it takes about 15 minutes or longer before completion of the oil conversion. The relationship shown in FIG. 10 gives evidence that complete oil conversion is not expected within a reaction time of 15 minutes although the oil yield is not necessarily low.

Under the same reaction conditions except that the reaction time is maintained at two minutes and different amounts of ZnO are added to the reaction system, respectively, to check the oil yield in relation to the variation in the amount of ZnO. The results are shown below.

| Amount of ZnO (g) | S:Zn | Yield of Oil (%) |
|---|---|---|
| 0 | 1:0.56 | incomplete conversion into oil |
| 0.058 | 1:1 | 92 |
| 0.50 | 1:4.4 | 88 |

The term "S:Zn" means the moles of sulfur in the rubber/the total moles of zinc in the system. The term "total moles of zinc in the system" is intended to mean the total by moles of zinc contained in the rubber and the zinc being added. From the above results, it will be seen that equimolar amounts of Zn and S are optimum although a wider range by mole of Zn:S may be used.

As stated hereinabove, metal oxides or salts may be used as the catalyst. Examples of the metal oxides or salts include ZnO, CoO, $MoO_3$, NiO, $Pd(NO_3)_2$, $Fe(ClO_4)_3$, $K_2S_2O_8$ and the like. These compounds may be used singly or in combination.

Composite compounds or oxides may also be used. Such composite compounds are available, for example, from Catalyst Chem. Ind. Co., Ltd., under the designations of HT-D3T (containing 3.7 wt % of CoO and 14.0 wt % of $MoO_3$), CDS-D21T (containing 4.5 wt % of CoO and 17.0 wt % of $MoO_3$) and the like. If these composite compounds are used in combination with a metal oxide such as ZnO, the reaction time can be shortened. The relation between the type of catalyst and the time before completion of the conversion reaction is as follows.

| Type of Catalyst | Reaction Time |
|---|---|
| ZnO | 2 minutes |
| HT-D3T | 2 minutes |
| CDS-D21T | 1 minute |
| Mixture of ZnO, HT-D3T and CDS-D21T (1:1:1 on weight basis) | 30 seconds |

Thus, a reaction time as short as 30 seconds can be realized for complete oil conversion when using the mixture.

In general, the metal oxide or salt is added in an amount of not less than 5 wt % based on the vulcanized rubber. Preferably, the metal is added in an amount equimolar to or higher than the amount of sulfur in the rubber.

Figure 11:
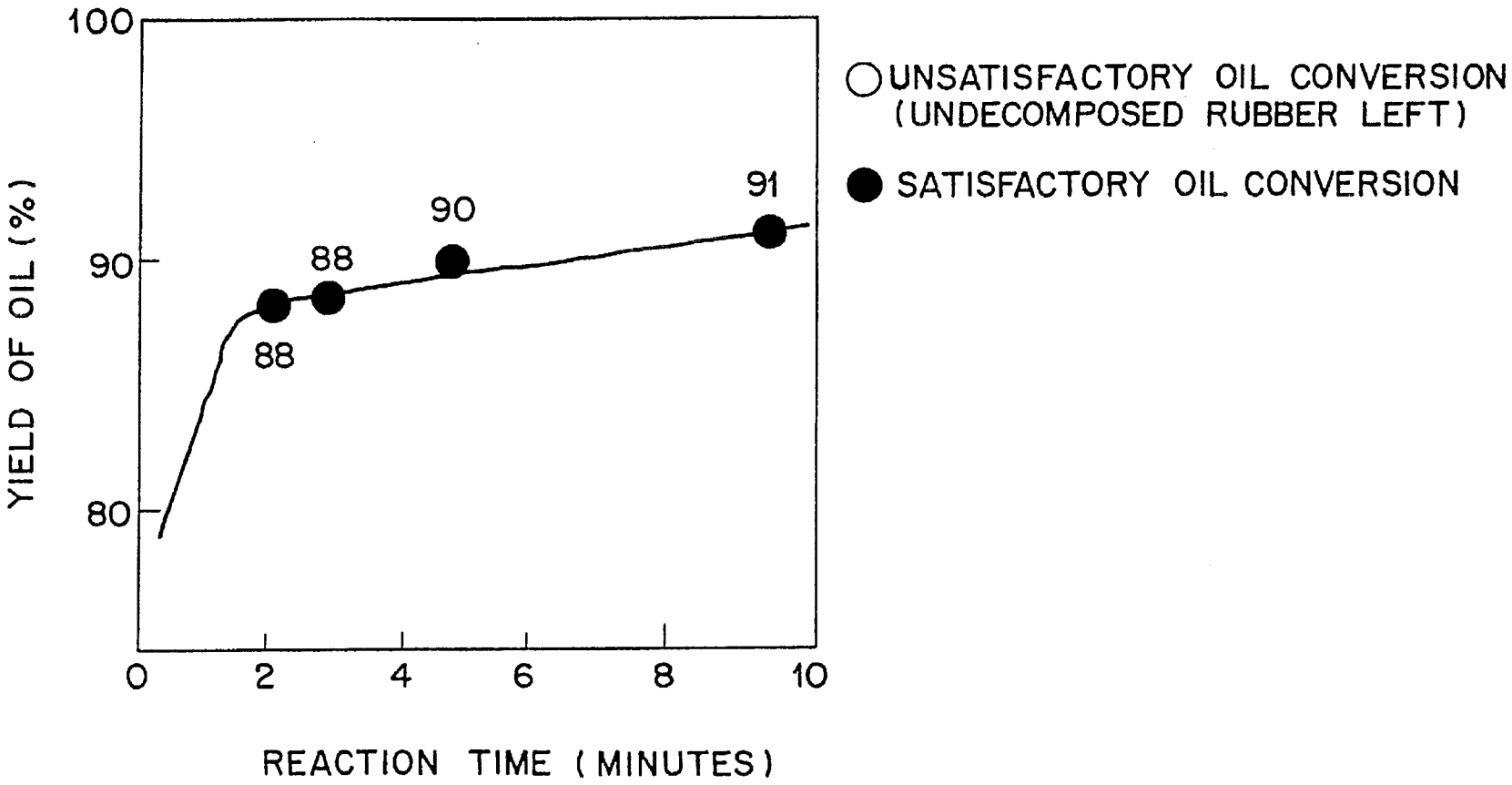
FIG. 11 is a graph showing the relation between the oil yield and the reaction time when the conversion reaction is effected in the presence of a metal salt or oxide catalyst.

In the same manner as in the case using a reaction time of 2 minutes set out hereinabove, the reaction time is changed to check the yield of oil. The results are shown in FIG. 11. The figure reveals that when the reaction time is 2 minutes or over, the field is 88% or higher and the oil conversion proceeds satisfactorily, i.e. any undecomposed rubber is not left in the reaction system. If ZnO is used in combination with CoO, $MoO_3$ or the like, a higher yield of 95% is attained within a shorter reaction time. More particularly, the reaction time in the order of seconds is possible.

Figure 12:
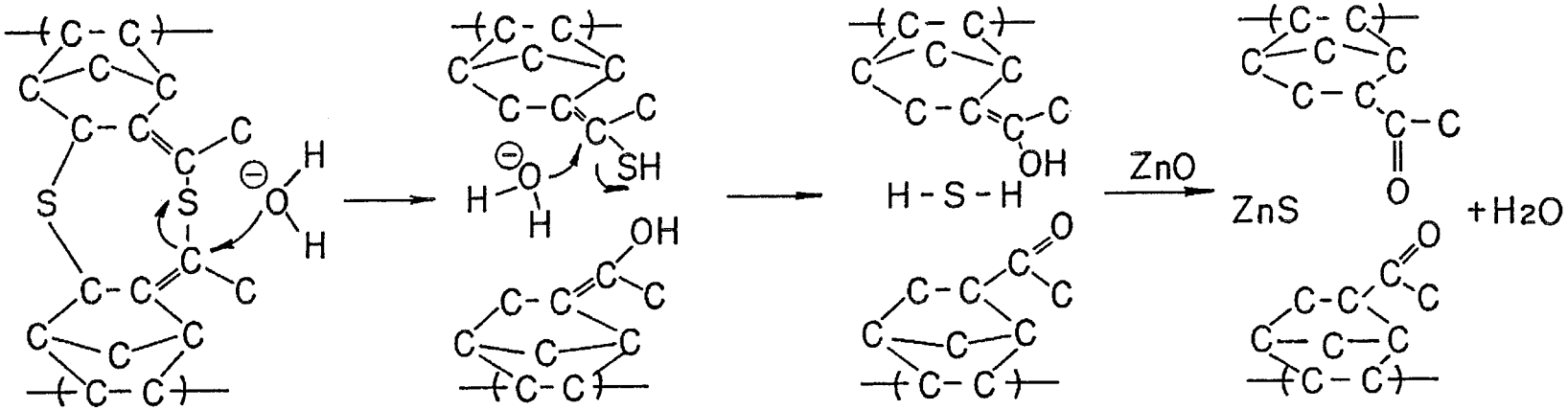
FIG. 12 is a schematic view showing the desulfurization mechanism according to the invention.

In the first embodiment, the sulfur-containing composition is desulfurized under hydrothermal conditions using metal oxides or salts. The desulfurization reaction is assumed to proceed as schematically shown in FIG. 12. More particularly, the metal oxide or salt serves to react with hydrogen sulfide which is produced during the course of splitting crosslinking chains owing to hydrolysis. By this, the hydrogen sulfide, i.e. sulfur, is removed from the sulfur-containing reaction.

Figure 13:
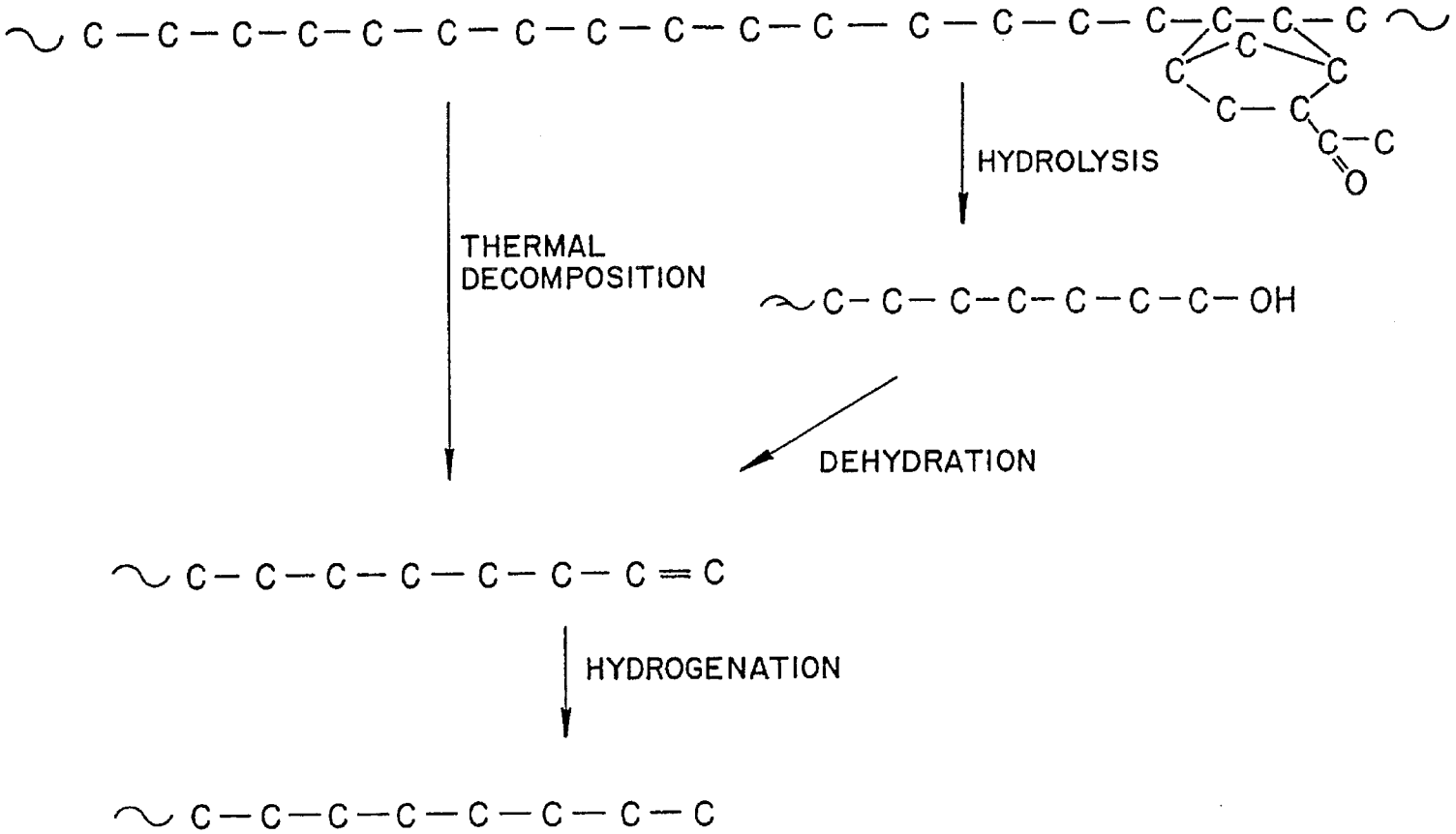
FIG. 13 is a schematic view showing the conversion reaction into a hydrocarbon oil according to the invention.

When a vulcanized rubber is used as in the second embodiment, sulfur is removed as shown in FIG. 12. When the thus sulfur-removed rubber product is further treated under supercritical conditions, the product will undergo dehydration and then hydrogenation to provide an oily substance. Alternatively, part of the vulcanized rubber will be directly thermally decomposed into low molecular weight compounds and then hydrogenated as is shown in FIG. 13. These reaction will be facilitated by addition of metal oxides or salts.

What is claimed is:

1. A process for the conversion of vulcanized rubber products into an oil mixture composed mainly of hydrocarbons which comprises providing a rubber product vulcanized with sulfur or a peroxide, adding an aqueous medium to the rubber product, subjecting the resultant mixture to decomposition under supercritical conditions of a temperature of from 374° to 500° C. and a pressure not lower than 225 $kg/cm^2$ thereby obtaining an oily substance mainly composed of mixed hydrocarbons.

2. A process according to claim 1, wherein the temperature ranges from 400° to 500° C.

3. A process according to claim 1, wherein the vulcanized rubber product is vulcanized ethylene-propylene-diene methylene linkage rubber.

4. A process according to claim 1, wherein said aqueous medium is water.

5. A process according to claim 1, wherein said aqueous medium is a basic aqueous medium.

6. A process according to claim 1, wherein said mixed hydrocarbons comprise paraffinic and olefinic hydrocarbons having from 15 to 25 carbon atoms.

7. A process according to claim 8, wherein said mixture is treated at a packing rate of from 10 to 40%, a weight percent of the vulcanized rubber of from 30 to 70% for a reaction time of not shorter than 15 minutes when said basic aqueous solution is used.

8. A process according to claim 1, wherein said mixture is treated after addition of a metal salt or oxide.

9. A process according to claim 8, wherein said metal salt or oxide consists essentially of zinc oxide.

10. A process according to claim 9, wherein said metal salt or oxide consists essentially of a mixture of zinc oxide with other metal oxide or salt.

11. A process according to claim 8, wherein said metal salt or oxide is present in an amount of not less than 5 wt % based on the vulcanized rubber.

* * * * *

UNITED STATES PATENT AND TRADEMARK OFFICE

CERTIFICATE OF CORRECTION

PATENT NO. : 5,502,262

DATED : March 26, 1996

INVENTOR(S) : Nakamichi Yamasaki et al

It is certified that error appears in the above-indentified patent and that said Letters Patent is hereby corrected as shown below:

Column 10, line 30; change "claim 8," to
---claim 1,---.

Signed and Sealed this

Tenth Day of September, 1996

Bruce Lehman

*Attest:*

BRUCE LEHMAN

*Attesting Officer*

*Commissioner of Patents and Trademarks*